US006852963B2

(12) United States Patent
Jeong

(10) Patent No.: US 6,852,963 B2
(45) Date of Patent: Feb. 8, 2005

(54) WALL-MOUNTED TYPE MICROWAVE OVEN

(75) Inventor: Sang-Jin Jeong, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/610,528

(22) Filed: Jul. 2, 2003

(65) Prior Publication Data

US 2004/0134901 A1 Jul. 15, 2004

(30) Foreign Application Priority Data

Jan. 9, 2003 (KR) ..... 10-2003-0001436

(51) Int. Cl.[7] ..... H05B 6/64

(52) U.S. Cl. ..... 219/756; 219/757; 219/746; 219/750; 219/691; 219/695; 219/745

(58) Field of Search ..... 219/756, 757, 219/746, 748, 750, 691, 693, 695–697, 745

(56) References Cited

U.S. PATENT DOCUMENTS 4,295,028 A 10/1981 Tanabe
4,319,110 A 3/1982 Tanabe et al.
4,463,238 A 7/1984 Tanabe
4,587,393 A 5/1986 Ueda
4,857,685 A * 8/1989 Vigano et al. ..... 219/707
6,335,518 B1 * 1/2002 Kim ..... 219/710

FOREIGN PATENT DOCUMENTS

JP 5-10912 1/1993

* cited by examiner

*Primary Examiner*—Shawntina Fuqua
(74) *Attorney, Agent, or Firm*—Staas & Halsey LLP

(57) ABSTRACT

A wall-mounted type microwave oven includes an outer cabinet defining an outer appearance thereof, an inner cabinet disposed in the outer cabinet to define a flow path therebetween, a sensor disposed in the flow path to check conditions of air flowing in the flow path, and a terminal unit connected to the sensor to transmit electric power and control signals to the sensor. The flow path includes a fitting hole to hold the sensor and the terminal unit. A sensor holder receives the sensor and the terminal unit, and is detachably fitted in the fitting hole. Only an operation of separating the sensor holder from a guide duct is performed in the guide duct, and an operation of pulling the sensor and the terminal unit out of the sensor holder and detaching the sensor from the terminal unit is performed outside the guide duct.

34 Claims, 4 Drawing Sheets

WALL-MOUNTED TYPE MICROWAVE OVEN

CROSS-REFERENCE TO RELATED APPLICATION

This application claims the benefit of Korean Application No. 2003-1436, filed Jan. 9, 2003, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven, which is adapted to allow a sensor to be easily fitted to and detached from the microwave oven.

2. Description of the Related Art

In general, a microwave oven is a cooking appliance which is intended to cook food by intermolecular frictional heating of the foods, which is generated by repeatedly agitating water molecules of the food with high-frequency electromagnetic energy. Among such microwave ovens, a microwave oven, which is fixedly installed over a cooking device such as a gas oven range to also serve as a hood to exhaust contaminated air to an outside, is usually referred to as a wall-mounted type microwave oven.

A conventional wall-mounted type microwave oven is generally installed over a gas oven range in a kitchen, and performs an operation of exhausting, for example, exhaust gas and fumes generated from the gas oven range disposed therebelow, to an outside, as well as a cooking operation as in a usual microwave oven.

The wall-mounted type microwave oven includes a cooking chamber to cook food therein, and an electric component compartment to receive various electric components, which are isolated from each other. The wall-mounted type microwave oven is provided with a ventilation flow path to cool the electric component compartment and to ventilate the cooking chamber, and an exhaust flow path to exhaust to the outside the gas and the fumes generated from the gas oven range positioned below the microwave oven.

The wall-mounted type microwave oven is further provided with various kinds of sensors to sense temperature or humidity of air flowing in the ventilation and exhaust flow paths.

To fit a sensor to one of the ventilation and exhaust flow paths of the wall-mounted type microwave oven, a wall, defining the one flow path, is formed with a hole. A terminal unit to transmit electric power and control signals to the sensor is fitted therein, and the sensor is connected to the terminal unit. The sensor is coupled to the terminal unit and held thereto by a sensor holder, which surrounds the sensor at one end thereof and surrounds the terminal unit at another end thereof. Therefore, the sensor is fixedly installed in the one flow path of the microwave oven.

However, separating the sensor holder surrounding the sensor and the terminal unit and detaching the sensor from the terminal unit are troublesome operations because the performance thereof must occur in a confined space when the sensor is in need of replacement with a new one or to repair the sensor, thus, a working efficiency thereof is decreased.

SUMMARY OF THE INVENTION

Accordingly, it is an aspect of the present invention to provide a wall-mounted type microwave oven, which allows a sensor to be easily fitted to and detached from the microwave oven.

Additional aspects and/or advantages of the invention will be set forth in part in the description which follows and, in part, will be obvious from the description, or may be learned by practice of the invention.

The above and/or other aspects are achieved by providing a wall-mounted type microwave oven including an outer cabinet defining an outer appearance of the wall-mounted type microwave oven, an inner cabinet disposed in the outer cabinet to define a flow path therebetween and including a cooking chamber and an electric component compartment therein, a sensor disposed in the flow path defined between the outer cabinet and the inner cabinet to check a condition of air flowing in the flow path, a terminal unit connected to the sensor to transmit electric power and control signals to the sensor, a fitting hole provided in a wall defining the flow path to hold the sensor and the terminal unit, and a sensor holder to hold the sensor and the terminal unit, coupled to each other therein, and to be detachably fitted in the fitting hole together with the sensor and the terminal unit.

The sensor includes a detector portion to check the condition of air flowing in the flow path, and a flange portion radially enlarged from the detector portion to be engaged with the sensor holder, and the sensor holder includes a ring portion sized to allow the detector portion of the sensor to pass therethrough and the flange portion of the sensor to be caught thereby, and at least two first elastic clips extending from the ring portion of the sensor holder to elastically support the terminal unit connected to the sensor.

The first elastic clips have hooks at inner facing surfaces thereof, respectively, which are protruded toward the terminal unit to prevent the terminal unit from being separated from the ring portion of the sensor holder.

The terminal unit includes elastic pieces provided at positions corresponding to the hooks of the first elastic clips to engage with the hooks.

The sensor holder includes at least two second elastic clips extending from the ring portion of the sensor holder to enable the sensor holder to be detachably fitted in the fitting hole.

The wall defining the flow path and having the fitting hole is formed with cut portions at positions adjacent to the fitting hole and corresponding to the second elastic clips, such that the second elastic clips are catchable by the cut portions, and each of the second elastic clips includes a "U"-shaped elastic portion extending from the ring portion, and an extension portion extending from a free end of the "U"-shaped elastic portion with a stepped portion therebetween.

The sensor may include a gas sensor to check an amount of humidity in air and an amount of gas contained in the air flowing in the microwave oven.

The fitting hole is provided at a guide duct, which is disposed at an upper portion of the cooking chamber to guide air discharged from the cooking chamber to a front surface of the outer cabinet.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
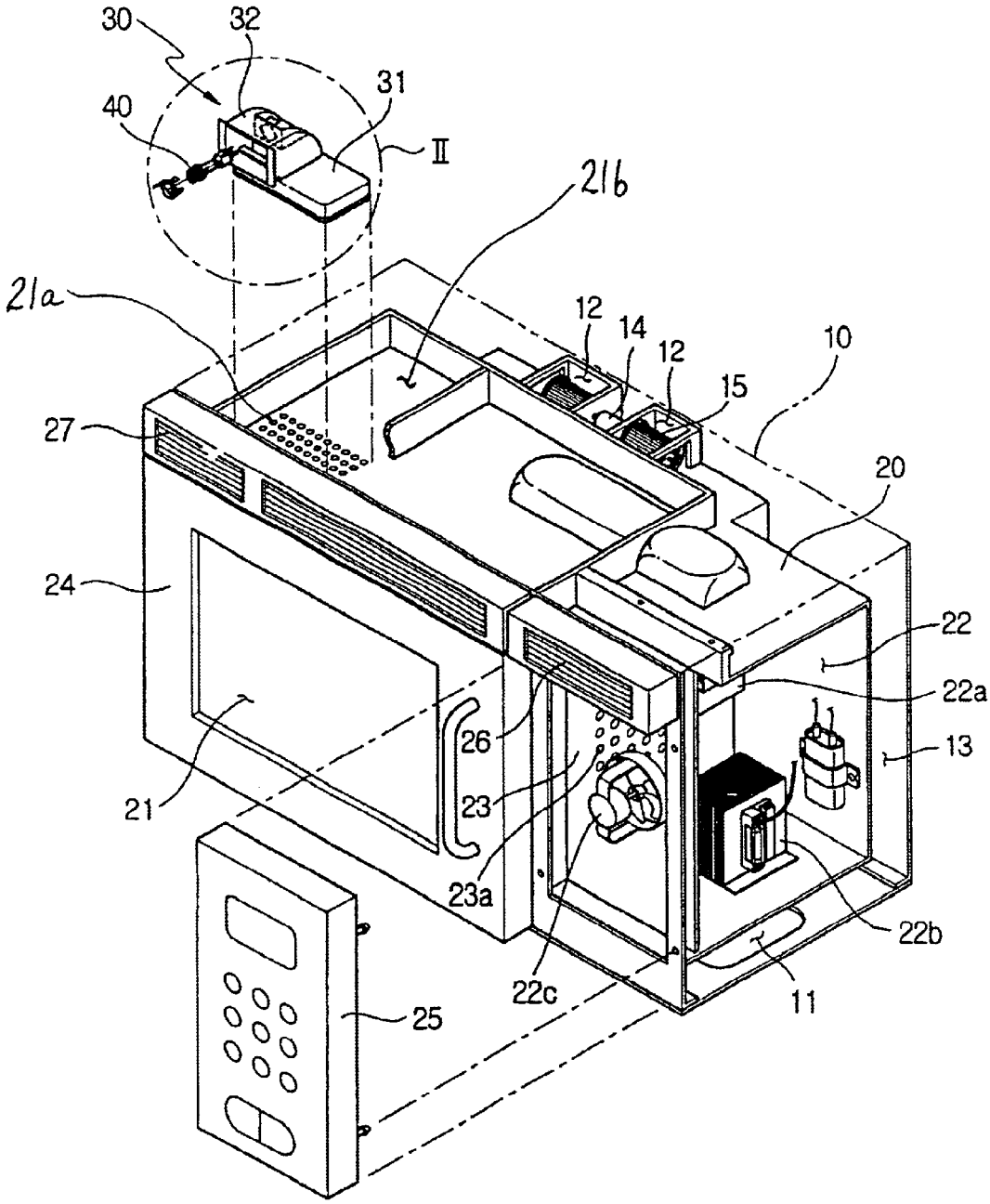
FIG. 1 is a perspective view of a wall-mounted type microwave oven, according to an embodiment of the present invention.

Reference will now be made in detail to the present preferred embodiment of the present invention, examples of which are illustrated in the accompanying drawings, wherein like reference numerals refer to like elements throughout.

FIG. 1 is a perspective view of a wall-mounted type microwave oven according to an embodiment of the present invention.

As shown in FIG. 1, the wall-mounted type microwave oven according to an embodiment of the present invention is installed on a lower surface of a ceiling or a kitchen cabinet, which is positioned over a gas oven range (not shown). The wall-mounted type microwave oven is provided at an upper surface thereof with an outer duct (not shown), which is connected to the wall-mounted type microwave oven through the ceiling or the kitchen cabinet, so as to guide exhaust gas and food odors generated from the gas oven range positioned therebelow, to an outside.

The wall-mounted type microwave oven includes an outer cabinet 10 defining an outer appearance of the wall-mounted type microwave oven, and an inner cabinet 20 disposed in the outer cabinet 10 with a predetermined spacing therebetween, so as to allow air to flow in the predetermined spacing.

The inner cabinet 20 is provided with a cooking chamber 21 therein to cook foods in the cooking chamber 21, and an electric component compartment 22 to receive various electric components, the cooking chamber 21 and electric component compartment 22 being isolated from each other by a partition plate 23 disposed therebetween. The cooking chamber 21 is opened and closed by a door 24 hingedly coupled to a front surface of the cooking chamber 21. The electric component compartment 22 is provided at a front surface thereof with a control panel 25 to control various operations of the wall-mounted type microwave oven, and the control panel 25 is positioned adjacent to the door 24.

The electric component compartment 22 is provided therein with electric components, such as a magnetron 22*a* to generate high-frequency electromagnetic waves into the cooking chamber 21, and a high voltage transformer 22*b* to apply a high voltage to the magnetron 22*a*. The electric component compartment 22 is further provided therein with a cooling fan 22*c* to cool the electric component compartment and to ventilate the cooking chamber 21, and a first air inlet 26 provided on the control panel 25 to allow indoor air to be introduced into the electric component compartment 22. Further, a first exhaust outlet 27 is provided on the door 24 to exhaust air discharged from the cooking chamber 21 to a room.

The partition plate 23 is formed with first vent holes 23*a* to allow the air in the electric component compartment 22 to be introduced into the cooking chamber 21. A top panel 21*b* of the cooking chamber 21 is formed with second vent holes 21*a* to allow the air in the cooking chamber to be discharged through the top panel 21*b*. A guide duct 30 is provided over the second vent holes 21*a* to allow the air discharged through the second vent holes 21*a* to be guided to the first exhaust outlet 27.

The guide duct 30 includes a first guide part 31 having an area corresponding to an area on which the second vent holes 21*a* are formed in the top panel 21*b*, to cover the second vent holes 21*a*, and a second guide part 32 extending from the first guide part 31 and having a opening corresponding to the first exhaust outlet 27 to cover the first exhaust outlet 27.

Thus, when the cooling fan 22*c* is operated, the air in the room is introduced into the electric component compartment 22 through the first air inlet 26 so as to cool the electric components installed in the electric component compartment 22. Further, the air in the electric component compartment 22 is introduced into the cooking chamber 21 through the first vent holes 23*a* to ventilate the cooking chamber 21, and discharged to the room through the second vent holes 21*a*, the guide duct 30 and the first exhaust outlet 27.

Furthermore, the wall-mounted type microwave oven includes a structure to exhaust gas generated from the gas oven range positioned therebelow. That is, a bottom panel of the outer cabinet 10, defining a lower surface of the wall-mounted type microwave oven, is provided at first and second sides with a second air inlet 11, so as to allow the gas and the food odors generated from the gas oven range, to be introduced into the outer cabinet 10, and a top panel of the outer cabinet 10, defining an upper surface of the wall-mounted type microwave oven, is provided with second exhaust outlets 12, so as to allow the gas and odors introduced into the outer cabinet 10 to be exhausted to the outside.

An inner duct 13 defined between the outer cabinet 10 and the inner cabinet 20 extends from under the inner cabinet 20 to the second exhaust outlets 12 through a rear surface of the inner cabinet 20, so as to guide the air introduced through the second air inlet 11 to the second exhaust outlets 12. The outer cabinet 10 is provided at a rear and upper portion thereof with a fan motor 14 to generate a rotating force, and a pair of exhaust fans 15 are joined to first and second driving shafts of the fan motor 14 to generate a suction force.

Contaminated air, generated by the gas oven range, is introduced into the outer cabinet 10 through the first air inlet 11 by the suction force provided by the fan motor 14 and the exhaust fans 15, and is guided to the outer duct (not shown) through the inner duct 13 and the second exhaust outlets 12 to allow the contaminated air to be exhausted to the outside.

The wall-mounted type microwave oven includes various kinds of sensors disposed in the flow path so as to check a temperature and an amount of humidity of air flowing in the flow path.

A gas sensor may be installed in the guide duct 30 to check the amount of humidity in the air and an amount of gas contained in the air flowing in the guide duct 30.

Figure 2:
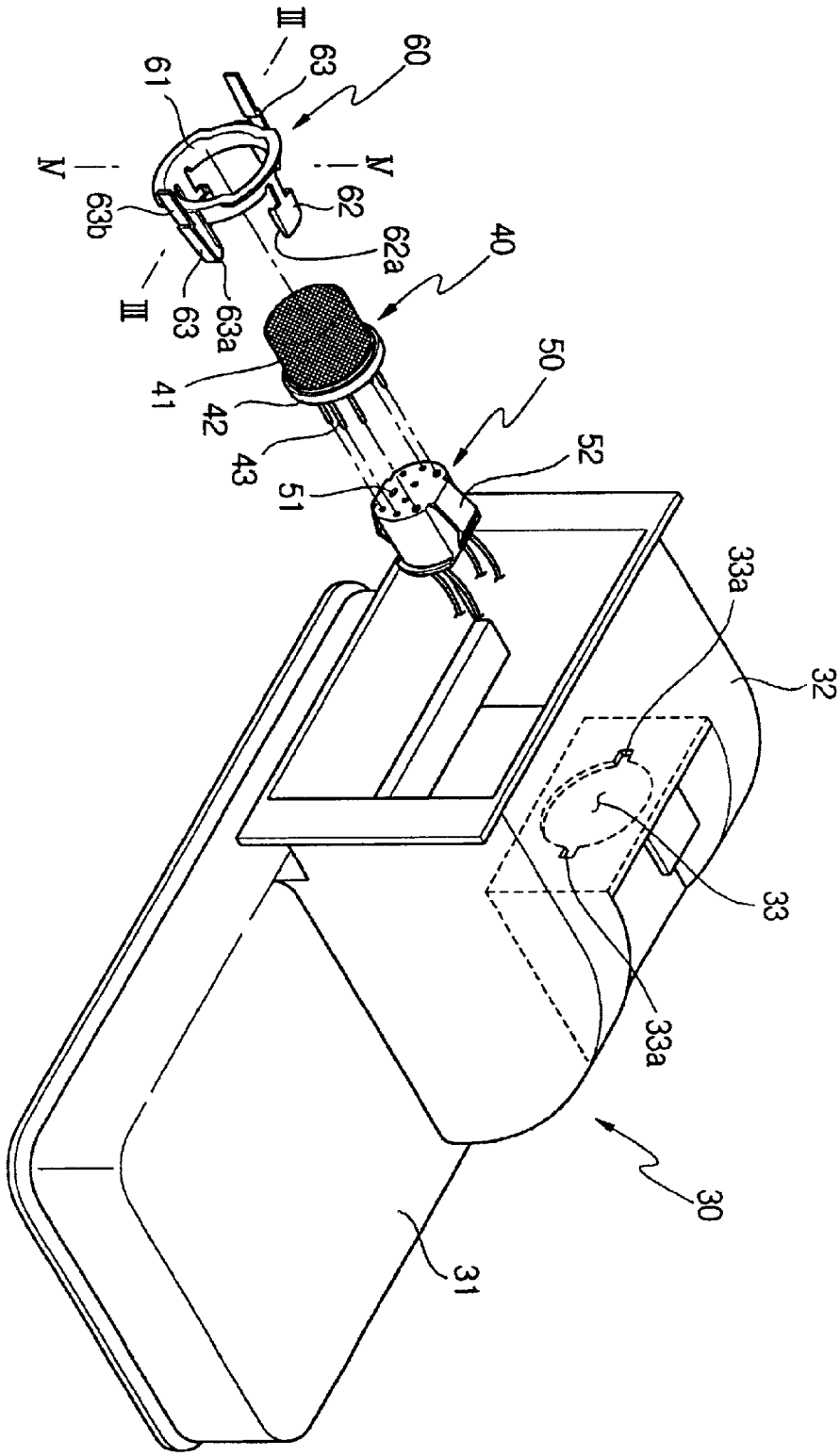
FIG. 2 is an enlarged perspective view of circular portion II of FIG. 1.

As shown in FIG. 2, the gas sensor 40 is installed in the guide duct 30. The guide duct 30 is formed with a circular fitting hole 33, which is adapted to receive the gas sensor 40. The gas sensor 40 is coupled to a terminal unit 50, so as to transmit electric power to the gas sensor 40 and to send signals generated from the gas sensor 40 to the control panel 25. The gas sensor 40 and the terminal unit 50 are fitted into a sensor holder 60 to maintain the gas sensor 40 and the terminal unit 50 in a connected state and to allow the gas sensor 40 to be detachably installed to the guide duct 30.

The gas sensor 40 includes a cylindrical detector portion 41 to sense the gas, and a flange portion 42 having a diameter larger than that of the cylindrical detector portion 41 and provided at a side of the cylindrical detector portion 41 to enable the gas sensor 40 to be fitted into the sensor holder 60. The gas sensor 40 further includes a plurality of connecting pins 43, provided at the flange portion 42, to allow the gas sensor 40 to be connected to the terminal unit 50.

The terminal unit 50 is provided to transmit the electric power and electrical signals to the gas sensor 40, and includes a plurality of connecting terminals 51 into which the plurality of connecting pins 43 of the gas sensor 40 are fitted, thereby allowing the gas sensor 40 to be electrically connected to the terminal unit 50.

The sensor holder 60 comprises a ring portion 61 having a predetermined diameter to allow the cylindrical detector portion 41 to pass therethrough and to cause the flange portion 42 to be caught thereby, at least two first elastic clips 62 extending from the ring portion 61 to cause the gas sensor 40 and the terminal unit 50, which are connected to each other, to be held in the ring portion 61, and at least two second elastic clips 63 extending from the ring portion 61 to cause the sensor holder 60 to be detachably fitted into the circular fitting hole 33.

Figure 3:
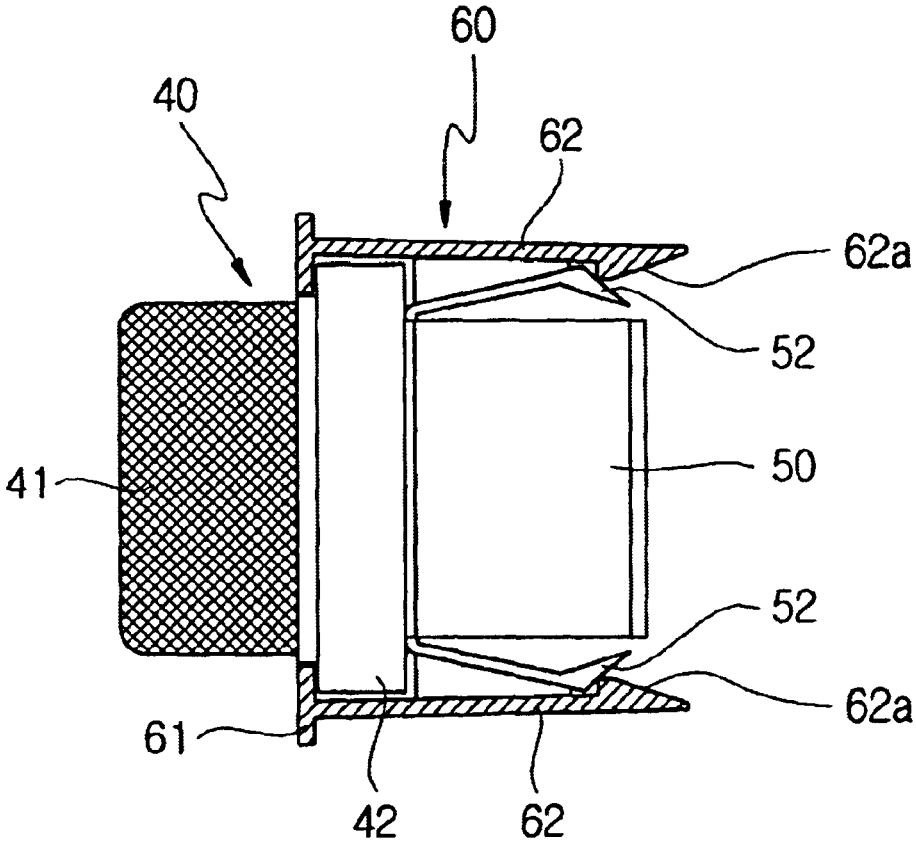
FIG. 3 is a cross-sectional view taken along line III—III of FIG. 2.

As shown in FIG. 3, a pair of the first elastic clips 62 symmetrically extends from the ring portion 61 toward the terminal unit 50. The pair of first elastic clips 62 is provided at inner facing surfaces thereof with bulging hooks 62*a*, respectively, to be engaged to the terminal unit 50. The terminal unit 50 includes two elastic pieces 52, which are adapted to be engaged to the bulging hooks 62*a* of the first elastic clips 62. Thus, when the gas sensor 40 and the terminal unit 60, which are connected to each other, are inserted into the sensor holder 60, the flange portion 42 of the gas sensor 40 is fitted into the ring portion 61 of the sensor holder 60, and the elastic pieces 52 of the terminal unit 50 are engaged to the bulging hooks 62*a* of the sensor holder 60. Therefore, the gas sensor 40 and the terminal unit 50 are detachably fitted into the sensor holder 60.

Figure 4:
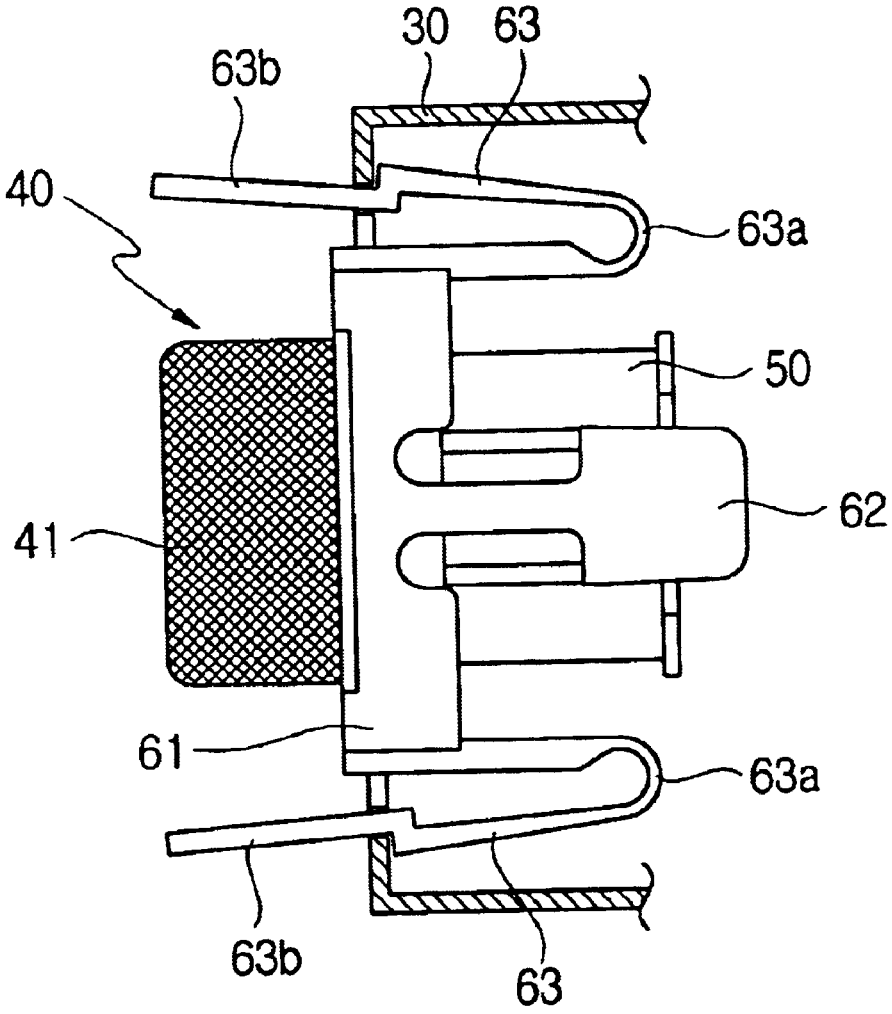
FIG. 4 is a cross-sectional view taken along line IV—IV of FIG. 2.

As shown in FIG. 4, each of the second elastic clips 63 includes a "U"-shaped elastic portion 63*a* extending from the ring portion 61, and an extension portion 63*b* extending from a free end of the "U"-shaped elastic portion 63*a* with a stepped portion therebetween, so as to cause the stepped portion of each of the second elastic clip 63 to be caught by the circular fitting hole 33. For an engagement between each of the second elastic clips 63 and the circular fitting hole 33, the guide duct 30 is formed with two cut portions 33*a* at diametrically opposite points on an edge of the circular fitting hole 33. Accordingly, when the sensor holder 60 is inserted into the circular fitting hole 33, the stepped portions of each of the second elastic clips 63 are caught by the cut portions 33*a* of the circular fitting hole 33, thereby causing the sensor holder 60 to be detachably fitted into the circular fitting hole 33.

Although the sensor holder 60 is used to hold the gas sensor 40, the sensor holder 60 may be used to hold other types of sensors than that of the gas sensor 40.

Furthermore, although the circular fitting hole 33 is described as being formed at the guide duct 30, the fitting hole 33 may be formed at any portion of a wall defining the flow path.

An operation of fitting and detaching the gas sensor 40 of the wall-mounted type microwave oven, according to the embodiment of the present invention will now be described with reference to the drawings.

First, an operation of installing the gas sensor 40 to the guide duct 30 is described. The gas sensor 40 is coupled to the terminal unit 50, and the coupled gas sensor 40 and terminal unit 50 are inserted into the sensor holder 60.

As the gas sensor 40 and the terminal unit 50 are inserted into the sensor holder 60, the flange portion 42 of the gas sensor 40 is fitted into the ring portion 61, and the elastic pieces 52 of the terminal unit 50 are engaged with the bulging hooks 62*a* of the first elastic clips 62. Therefore, the gas sensor 40 and the terminal unit 50 are firmly held in the sensor holder 60.

Further, the sensor holder 60, in which the gas sensor 40 and the terminal unit 50 are held, is inserted into the circular fitting hole 33 of the guide duct 30. At this point, the stepped portions of the second elastic clips 63 are caught by the cut portions 33*a* of the circular fitting hole 33, thereby causing the gas sensor 40 to be fitted in the circular fitting hole 33.

When a replacement of a defective gas sensor 40 with a new one is needed, the second elastic clips 63 of the sensor holder 60, which are fitted to the guide duct 30, are pushed toward each other by a user to disengage the stepped portions of the second elastic clips 63. Thereafter, the sensor holder 60 is forwardly pulled from the guide duct 30.

Subsequently, the pair of first elastic clips 62 is outwardly deformed to allow the gas sensor 40 and the terminal unit 50 to be separated from the sensor holder 60. The gas sensor 40 is detached from the terminal unit 50, and replaced with a new gas sensor. Accordingly, a major portion of an operation of installing and detaching the gas sensor 40 is performed outside the guide duct 30.

As is apparent from the above description, a wall-mounted type microwave oven with a sensor holder to hold a gas sensor and a terminal unit therein, the sensor holder being detachably fitted to a guide duct. Accordingly, only an operation of separating the sensor holder from the guide duct is performed in the guide duct, and an operation of pulling the gas sensor and the terminal unit out of the sensor holder and detaching the gas sensor from the terminal unit is performed outside the guide duct. Therefore, the wall-mounted type microwave oven enables the gas sensor to be easily fitted to and detached from the wall-mounted type microwave oven.

Although an embodiment of the present invention has been shown and described, it would be appreciated by those skilled in the art that changes may be made in the embodiment without departing from the principles and spirit of the invention, the scope of which is defined in the claims and their equivalents.

What is claimed is:

1. A wall-mounted type microwave oven, comprising:

an outer cabinet defining an outer appearance of the wall-mounted-type microwave oven;

an inner cabinet disposed in the outer cabinet to define a flow path therebetween and including a cooking chamber and an electric component compartment therein;

a sensor disposed in the flow path defined between the outer cabinet and the inner cabinet to check a condition of air flowing in the flow path;

a terminal unit connected to the sensor to transmit electric power and control signals to the sensor;

a fitting hole provided at a wall defining the flow path to hold the sensor and the terminal unit; and a sensor holder to hold the sensor and the terminal unit coupled to each other therein, and to be detachably fitted in the fitting hole together with the sensor and the terminal unit.

2. The wall-mounted type microwave oven as set forth in claim 1, wherein:

the sensor comprises:

a detector portion to check the condition of the air flowing in the flow path, and a flange portion radially enlarged from the detector portion to engage with the sensor holder; and the sensor holder comprises:

a ring portion sized to allow the detector portion to pass therethrough and to catch the flange portion of the sensor thereby, and at least two first elastic clips extending from the ring portion to elastically support the terminal unit connected to the sensor.

3. The wall-mounted type microwave oven as set forth in claim 2, wherein each of the first elastic clips comprises:

a plurality of hooks provided at inner facing surfaces thereof, which protrude toward the terminal unit to prevent the terminal unit from separating from the ring portion of the sensor holder.

4. The wall-mounted type microwave oven as set forth in claim 3, wherein the terminal unit comprises:

a plurality of elastic pieces provided at positions corresponding to the plurality of hooks of the first elastic clips to respectively engage with respective ones of the plurality of the hooks.

5. The wall-mounted type microwave oven as set forth in claim 2, wherein the sensor holder further comprises:

at least two second elastic clips extending from the ring portion of the sensor holder to enable the sensor holder to detachably fit in the fitting hole.

6. The wall-mounted type microwave oven as set forth in claim 5, wherein:

the wall defining the flow path and having the fitting hole is formed with cut portions at positions adjacent to the fitting hole and corresponding to the at least two second elastic clips, so as to cause the at least two second elastic clips to be caught by the cut portions, respectively, each of the second elastic clips comprises:

a "U"-shaped elastic portion extending from the ring portion of the sensor holder;

an extension portion extending from a free end of the "U"-shaped elastic portion; and a stepped portion between the "U"-shaped elastic portion and the extension portion.

7. The wall-mounted type microwave oven as set forth in claim 1, wherein the sensor comprises:

a gas sensor to check an amount of humidity in the air flowing in the flow path and an amount of gas contained in the air flowing in the flow path.

8. The wall-mounted type microwave oven as set forth in claim 1, further comprising;

a guide duct disposed at an upper portion of the cooking chamber to guide air discharged from the cooking chamber to a front surface of the outer cabinet, wherein the fitting hole is provided at the guide duct.

9. A wall-mounted type microwave oven having an exhaust path to exhaust air therebelow, and a fitting hole formed at a wall defining the exhaust path, comprising:

a sensor disposed in the exhaust path to check a condition of air flowing in the exhaust path;

a terminal unit connected to the sensor to provide electric power and control signals to the sensor; and a sensor holder to hold the sensor and the terminal unit coupled to each other therein, and to detachably fit in the fitting hole together with the sensor and the terminal unit.

10. The wall-mounted type microwave oven as set forth in claim 9, wherein:

the sensor comprises:

a detector portion to check the condition of the air flowing in the exhaust path, and a flange portion larger in a radius thereof than that of the detector portion to detachably engage with the sensor holder; and the sensor holder comprises:

a ring portion to allow the detector portion to pass therethrough and to detachably engage with the flange portion of the sensor, and two or more first clips extending from the ring portion to elastically support the terminal unit connected to the sensor.

11. The wall-mounted type microwave oven as set forth in claim 10, wherein each of the first clips comprises:

a plurality of hooks provided at inner facing surfaces thereof and protruding toward the terminal unit to prevent the terminal unit from separating from the ring portion of the sensor holder.

12. The wall-mounted type microwave oven as set forth in claim 11, wherein the terminal unit comprises:

a plurality of elastic pieces provided at positions corresponding to the plurality of hooks of the first clips to respectively engage with the plurality of hooks.

13. The wall-mounted type microwave oven as set forth in claim 11, wherein the sensor holder further comprises:

two or more second clips extending from the ring portion of the sensor holder to detachably fit the sensor holder into the fitting hole.

14. The wall-mounted type microwave oven as set forth in claim 13, further comprising:

a wall defining the exhaust path formed with cut portions at positions adjacent to the fitting hole and corresponding to the two or more second clips, so as engage with respective ones of the two or more second clips by the cut portions.

15. The wall-mounted type microwave oven as set forth in claim 13, wherein each of the second clips comprises:

a "U"-shaped portion extending from the ring portion of the sensor holder;

an extension portion extending from a free end of the "U"-shaped portion; and a stepped portion between the "U"-shaped portion and the extension portion.

16. The wall-mounted type microwave oven as set forth in claim 9, wherein the sensor comprises:

a gas sensor to check an amount of humidity in the air flowing in the exhaust path and an amount of gas contained in the air flowing in the exhaust path.

17. The wall-mounted type microwave oven as set forth in claim 9, further comprising;

a cooking chamber; and a guide duct disposed at an upper front surface of the wall-mounted type microwave oven to guide air discharged from the cooking chamber such that the sensor is provided in the guide duct.

18. The wall-mounted type microwave oven as set forth in claim 17, further comprising;

an inner cabinet defining the cooking chamber therein; and an outer cabinet defining an appearance of an exterior of the wall-mounted type microwave, wherein the exhaust path is defined between the inner and outer cabinets.

19. The wall-mounted type microwave oven as set forth in claim 9, wherein the sensor is provided to check one or more of a temperature, a humidity and a gas concentration in the exhaust path.

20. The wall-mounted type microwave oven as set forth in claim 9, wherein:

the flange portion of the sensor comprises:

a plurality of connecting pins to detachably connect the sensor to the terminal unit; and the terminal unit comprises:

a plurality of connecting terminals into which respective ones of the plurality of connecting pins of the sensor are fittable to electrically connect the sensor to the terminal unit.

21. The wall-mounted type microwave oven as set forth in claim 9, wherein:

the sensor is detachable from the terminal unit outside of the wall mounted-type microwave oven.

22. A sensor unit to fit to a wall of an exhaust path of a wall-mounted type microwave oven, comprising:

a sensor disposed in the exhaust path to check a condition of air flowing in the exhaust path;

a terminal unit connected to the sensor to provide electric power and control signals to the sensor; and a sensor holder to hold the sensor and the terminal unit coupled to each other therein, and to detachably attach to the wall of the exhaust path together with the sensor and the terminal unit.

23. The wall-mounted type microwave oven as set forth in claim 22, wherein:

the sensor comprises:

a detector portion to check the condition of the air flowing in the exhaust path, and a flange portion larger in a radius thereof than that of the detector portion to detachably engage with the sensor holder; and the sensor holder comprises:

a ring portion to allow the detector portion to pass therethrough and to detachably engage with the flange portion of the sensor; and two or more first clips extending from the ring portion to elastically support the terminal unit connected to the sensor.

24. The wall-mounted type microwave oven as set forth in claim 23, wherein each of the first clips comprises:

a plurality of hooks provided at inner facing surfaces thereof and protruding toward the terminal unit to prevent the terminal unit from separating from the ring portion of the sensor holder.

25. The wall-mounted type microwave oven as set forth in claim 24, wherein the terminal unit comprises:

a plurality of elastic pieces provided at positions corresponding to the plurality of hooks of the first clips to respectively engage with the plurality of hooks.

26. The wall-mounted type microwave oven as set forth in claim 24, wherein the sensor holder further comprises:

two or more second clips extending from the ring portion of the sensor holder to detachably fit the sensor holder into the fitting hole.

27. The wall-mounted type microwave oven as set forth in claim 26, further comprising:

a wall defining the exhaust path formed with cut portions at positions adjacent to the fitting hole and corresponding to the two or more second clips, so as engage with respective ones of the two or more second clips by the cut portions.

28. The wall-mounted type microwave oven as set forth in claim 26, wherein each of the second clips comprises:

a "U"-shaped portion extending from the ring portion of the sensor holder;

an extension portion extending from a free end of the "U"-shaped portion; and a stepped portion between the "U"-shaped portion and the extension portion.

29. The wall-mounted type microwave oven as set forth in claim 22, wherein the sensor comprises:

a sensor to check an amount of humidity in the air flowing in the exhaust path and an amount of gas contained in the air flowing in the exhaust path.

30. The wall-mounted type microwave oven as set forth in claim 22, further comprising;

a cooking chamber therein; and a guide duct disposed at an upper front surface of the wall-mounted type microwave oven to guide air discharged from the cooking chamber such that the sensor is provided in the guide duct.

31. The wall-mounted type microwave oven as set forth in claim 30, further comprising;

an inner cabinet defining the cooking chamber therein; and an outer cabinet defining an appearance of an exterior of the wall-mounted type microwave, wherein the exhaust path is defined between the inner and outer cabinets.

32. The wall-mounted type microwave oven as set forth in claim 22, wherein the sensor is provided to check one or more of a temperature, a humidity and a gas concentration in the exhaust path.

33. The wall-mounted type microwave oven as set forth in claim 22, wherein:

the flange portion of the sensor comprises:

a plurality of connecting pins to detachably connect the sensor to the terminal unit; and the terminal unit comprises:

a plurality of connecting terminals into which respective ones of the plurality of connecting pins of the sensor are fittable to electrically connect the sensor to the terminal unit.

34. A microwave oven having an exhaust path to exhaust air, and a fitting hole formed at a wall defining the exhaust path, comprising:

a sensor disposed in the exhaust path to check a condition of air flowing in the exhaust path;

a terminal unit connected to the sensor to provide electric power and control signals to the sensor; and a sensor holder to hold the sensor and the terminal unit coupled to each other therein, and to detachably fit in the fitting hole together with the sensor and the terminal unit such that a detachment of the sensor from the terminal unit occurs outside of the microwave oven.

* * * * *

UNITED STATES PATENT AND TRADEMARK OFFICE

CERTIFICATE OF CORRECTION

PATENT NO. : 6,852,963 B2
DATED : February 8, 2005
INVENTOR(S) : Sang-jin Jeong

It is certified that error appears in the above-identified patent and that said Letters Patent is hereby corrected as shown below:

Column 8,
Line 36, insert -- to -- after "as";

Column 10,
Line 3, insert -- to -- after "as".

Signed and Sealed this

Sixteenth Day of May, 2006

JON W. DUDAS
*Director of the United States Patent and Trademark Office*